US012782085B2

(12) United States Patent
Platt

(10) Patent No.: US 12,782,085 B2
(45) Date of Patent: Nov. 3, 2026

(54) MOUNT FOR A FIREARM

(71) Applicant: W&E Platt Pty Ltd, Ingleburn (AU)

(72) Inventor: Allan Platt, Theresa Park (AU)

(73) Assignee: W&E Platt Pty Ltd, Ingleburn (AU)

( * ) Notice: Subject to any disclaimer, the term of this patent is extended or adjusted under 35 U.S.C. 154(b) by 0 days.

(21) Appl. No.: 19/013,057

(22) Filed: Jan. 8, 2025

(65) Prior Publication Data

US 2025/0224201 A1 Jul. 10, 2025

(30) Foreign Application Priority Data

Jan. 8, 2024 (AU) ..... 2024900043

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
CPC ..... F41C 27/00; F41G 11/003
See application file for complete search history.

(56) References Cited

U.S. PATENT DOCUMENTS 3,178,823 A * 4/1965 Lipski ..... F41G 1/38 42/126
8,424,234 B2 * 4/2013 Carlson ..... F41G 11/001 42/90
8,505,229 B2 * 8/2013 Savoy ..... F41G 11/003 42/148
9,417,034 B1 * 8/2016 Swan ..... F41G 1/17
11,561,068 B1 * 1/2023 Carter ..... F41G 11/003
11,933,584 B2 * 3/2024 Carter ..... F41G 11/003
12,135,190 B2 * 11/2024 Zimmer ..... F41G 11/003
12,313,378 B2 * 5/2025 Carter ..... F41G 11/008
2006/0162227 A1 7/2006 Samson
2011/0296732 A1 * 12/2011 Carlson ..... F41G 11/008 42/90
2015/0020429 A1 * 1/2015 Savoy ..... F41G 11/008 42/111
2025/0224201 A1 * 7/2025 Platt ..... F41C 27/00

FOREIGN PATENT DOCUMENTS

EP 3553457 A1 10/2019

OTHER PUBLICATIONS

Machine-assisted English language abstract and machine-assisted English language translation for EP 3 553 457 A1 extracted from espacenet.com database on Jun. 12, 2025, 15 pages.

* cited by examiner

*Primary Examiner* — Michelle Clement
(74) *Attorney, Agent, or Firm* — Howard & Howard Attorneys PLLC

(57) ABSTRACT

A mount for attaching one or more firearm accessories to a firearm. The mount comprises a base that is mountable to an upper portion of the firearm, an arm adapted for coupling to a first firearm accessory, and a release assembly connected to the base. The arm is pivotally coupled to the base whereby in an engaged configuration the arm is retained adjacent the base, and in a disengaged configuration the arm is able to pivot away from the base. When actuated the release assembly is adapted to release the arm from the engaged configuration wherein the arm is able to pivot towards the disengaged configuration.

16 Claims, 12 Drawing Sheets

MOUNT FOR A FIREARM

TECHNICAL FIELD

This disclosure relates generally to firearms, and in particular to a mount for attaching one or more firearm accessories to a firearm.

BACKGROUND

Firearm accessories, such as sights, tactical lights, and grips, are typically able to be mounted to a firearm via a mounting bracket on the gun's receiver, handguard, or fore-end stock. Historical mounting brackets range from a raised metal strip with undercut sides, or a dovetail design, that allowed accessories to be slidably secured by means of compression, to the more modern Picatinny rail that provides a hexagonal top cross-section, with evenly spaced cross slots and an undercut strip along the sides that together allow accessories to be slid into place from the end of the rail and then locked in place.

Some firearm accessories are bulky and protrude beyond the firearm's general contour. Some prior art mounting brackets allow for the removal of the accessory. However, such mounts typically require that the accessory be re-aligned before it is ready for use.

There remains a need for a mount for attaching firearm accessories to a firearm that may enable faster deployment or stowage of the attached accessories when needed. There may also be a need for a mount for attaching firearm accessories to a firearm that, when moved from a stowed configuration to a deployed configuration, aligns the firearm accessories such that they are ready for use.

SUMMARY OF THE DISCLOSURE

In a first aspect, embodiments are disclosed of a mount for attaching one or more firearm accessories to a firearm. The mount comprises a base that is mountable to an upper portion of the firearm, an arm adapted for coupling to a first firearm accessory, and a release assembly connected to the base. The arm is pivotally coupled to the base whereby in an engaged configuration the arm is retained adjacent the base, and in a disengaged configuration the arm is able to pivot away from the base. When actuated the release assembly is adapted to release the arm from the engaged configuration wherein the arm is able to pivot towards the disengaged configuration.

In some embodiments, the release assembly may be actuated by a pivotal movement of the release assembly relative to the base. In some embodiments, the pivotal movement of the release assembly may be via a pivot connecting the release assembly to the base, a rotation axis of the pivot extending perpendicularly to a longitudinal axis of the base.

In some embodiments, the release assembly extends from the base in a direction towards a surface of the firearm. In some embodiments, a length of the release assembly in the direction towards a surface of the firearm may be adjustable.

In some embodiments, a leading edge may be coupled to a distal end of the release assembly. In some embodiments, the leading edge may be interchangeable with a further leading edge of a larger and/or a smaller diameter, thereby adjusting the length of the release assembly in the direction towards a surface of the firearm. In some embodiments, the release assembly may further comprise a handle.

In some embodiments, the release assembly may be biased towards the engaged configuration. In some embodiments, the mount may comprise a latch and a hook arrangement, wherein when the latch and the hook engage one another they retain the arm in the engaged configuration. In some embodiments, actuation of the release assembly may disengage the latch from the hook.

In some embodiments, the release assembly may include a slidable member comprising the latch or the hook. In some embodiments, actuation of the release assembly may cause the slidable member to move longitudinally relative to the base of the mount between a locked configuration, where the latch is engaged with the hook, and an unlocked configuration, where the latch is disengaged from the hook. In some embodiments, the mount may comprise a plurality of corresponding pairs of the latches and the hooks. In some embodiments, the arm may be arranged to pivot about a hinge relative to the base, a rotation axis of the hinge extending parallel to a longitudinal axis of the base. In some embodiments, the hinge may be spring-loaded.

In some embodiments, in the disengaged configuration the arm may be able to pivot substantially 90 degrees relative to the base. In some embodiments, in the engaged configuration a height and/or an angle of the arm may be adjustable relative to the base. In some embodiments, one or more threaded screws may be arranged to extend through a corresponding one or more apertures of the base so as to project through the base and interact with an underside of the arm.

In some embodiments, the mount may comprise a platform for coupling to a second firearm accessory, the platform locating adjacent the arm and being fixed relative to the base. In some embodiments, in the engaged configuration a top surface of the arm and a top surface of the platform may be at a substantially uniform height above the base.

In a further aspect, embodiments are disclosed of a firearm assembly comprising the mount as described in the first aspect mounted to the upper portion of the firearm. In some embodiments, the firearm assembly may further comprise the first firearm accessory coupled to the arm of the mount. In some embodiments, the firearm assembly may further comprise the second firearm accessory coupled to the platform of the mount. In some embodiments, the first firearm accessory may comprise one or more of a lights, sight, grip, bipod or tripod, sling, and bayonet. In some embodiments, the second firearm accessory may comprise one or more of a lights, sight, grip, bipod or tripod, sling, and bayonet.

In some embodiments, the upper portion of the firearm may be a door which is able to be pivotally opened. In some embodiments, the door may be able to pivot through 90 degrees relative to a closed configuration. In some embodiments, when the door is pivoted to an open configuration the release assembly may be actuated to release the arm from the engaged configuration. In some embodiments, in the open configuration the leading edge may interact with the surface of the firearm such that the release assembly is moved pivotally about the pivot that connects the release assembly to the base whereby the slidable member is moved longitudinally relative to the base of the mount to disengage the latch from the hook.

Other aspects, features, and advantages will become apparent from the following detailed description when taken in conjunction with the accompanying drawings, which are a part of this disclosure and which illustrate, by way of example, principles of inventions disclosed.

DESCRIPTION OF THE FIGURES

The accompanying drawings facilitate an understanding of the various embodiments. The invention will now be described, by way of non-limiting example only, with reference to the accompanying drawings, in which.

DETAILED DESCRIPTION

Figure 1A:
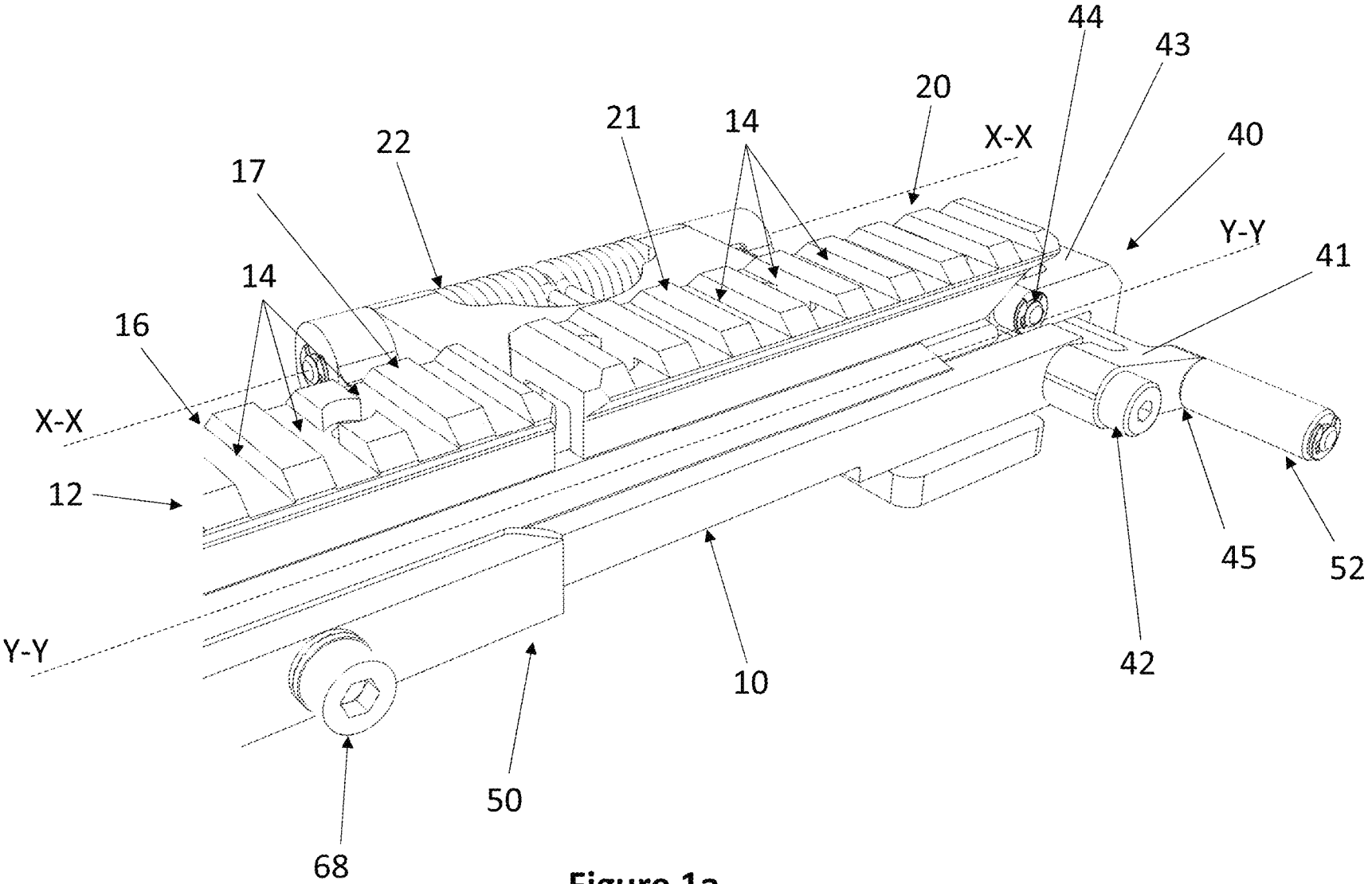
FIGS. 1*a* and 1*b* are rear and front perspective views, respectively, of a forward portion of a first embodiment of a mount for attaching one or more firearm accessories to a firearm, with the arm in an engaged configuration.

Referring to the figures, a mount 50 is shown that is adapted for securing one or more firearm accessories 80 to a firearm 60. The firearm accessory 80 can be any accessory that is commonly compatible with mounts for firearms, including but not limited to an optical, telescopic, holographic, laser, reflector, thermal and/or backup iron sight, and a night-vision scope. The firearm 60 can be any rifle, pistol, or other portable or non-portable gun commonly compatible with mounts for integrating accessories. Where like reference numerals are used in the following description, the features are considered to be the same unless specified as being otherwise.

Figure 1B:
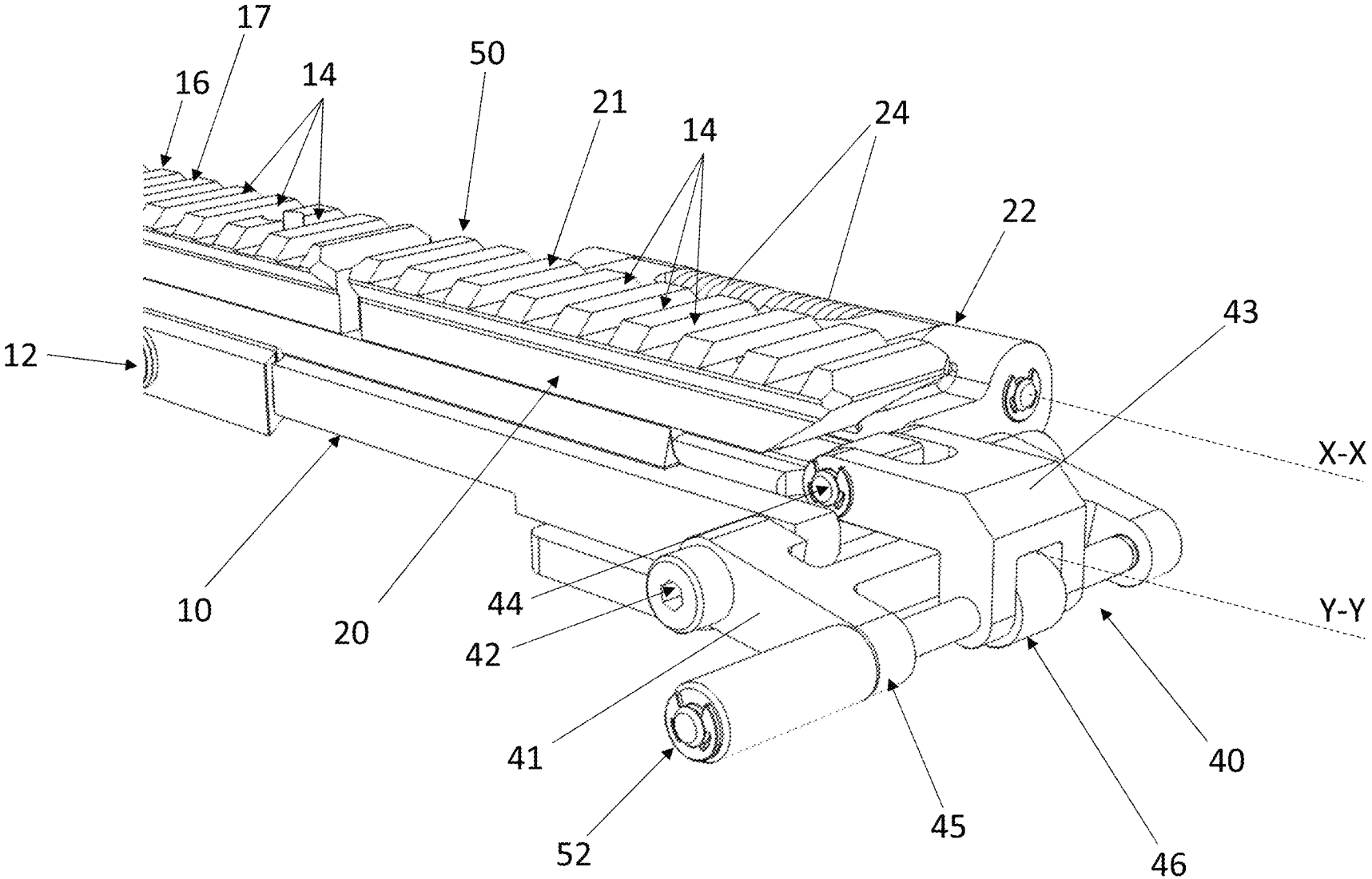
Figure 2A:
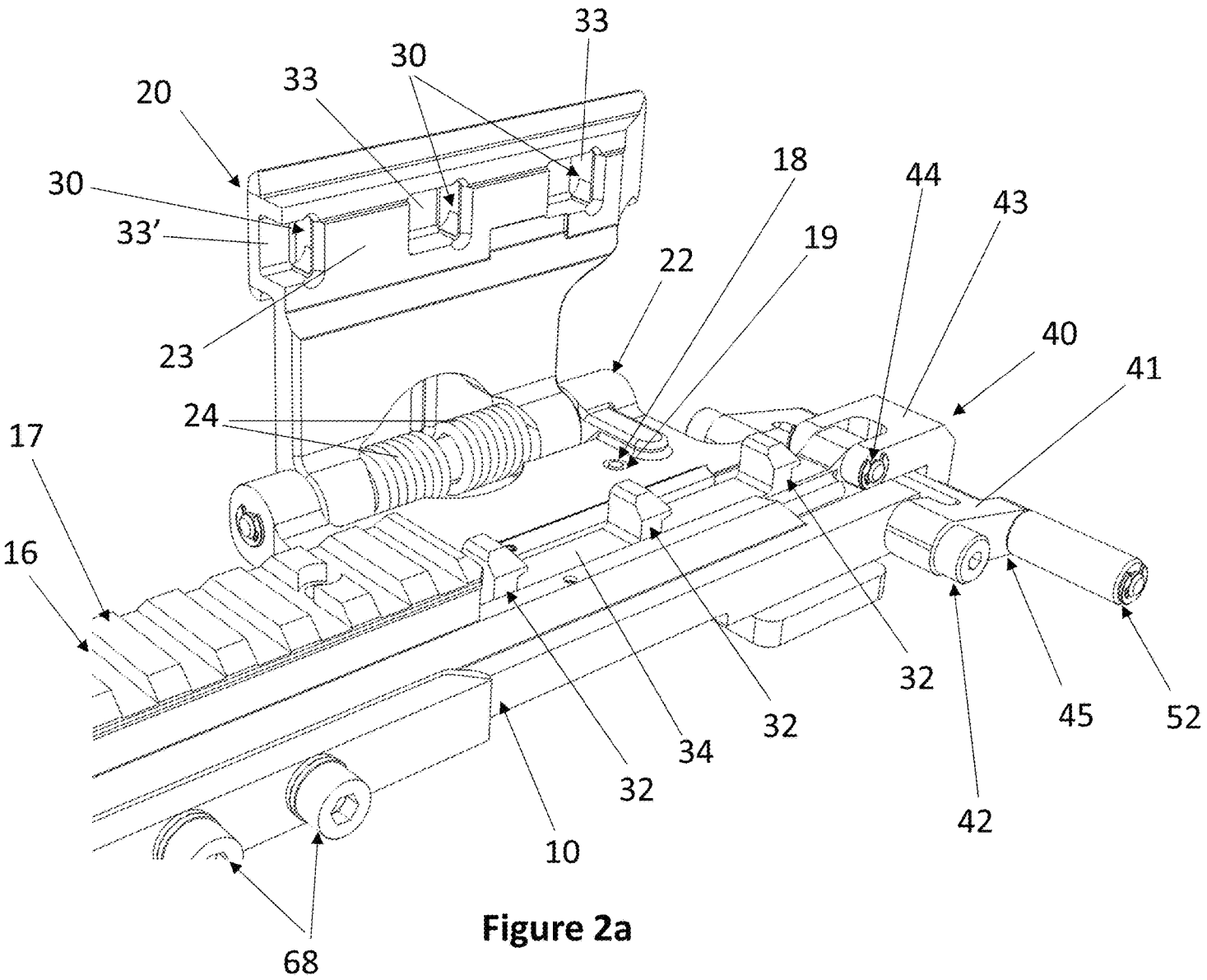
FIGS. 2*a* and 2*b* are rear and front perspective views, respectively, of a forward portion of the mount of FIG. 1, with the arm in a disengaged configuration.
Figure 2B:
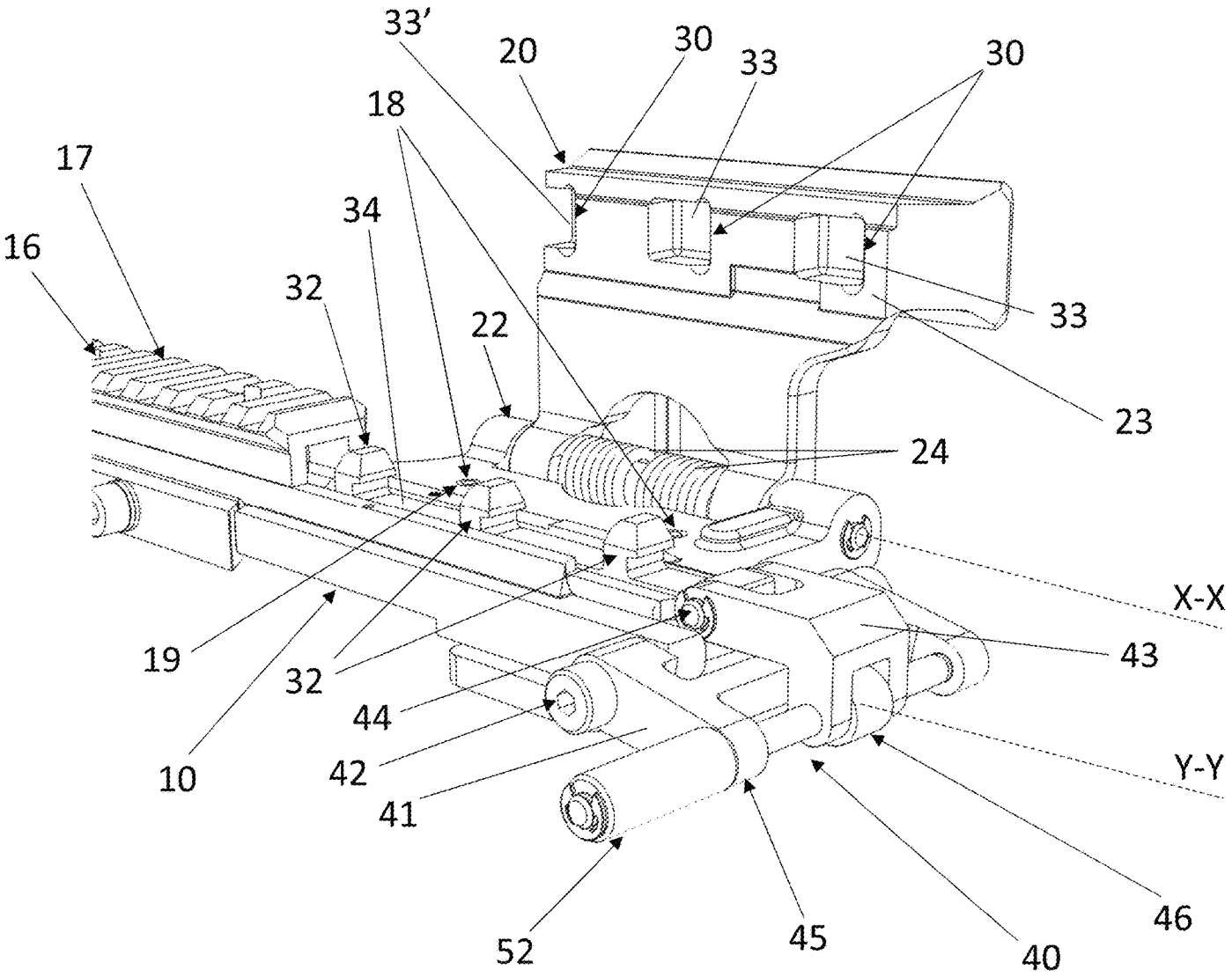

Referring to FIGS. 1 and 2, the mount 50 comprises an elongate base 10 that is able to be mounted to an upper portion of the firearm 60. The base 10 supports a mounting platform 12 that comprises a plurality of laterally extending square-bottomed slots 14 that are longitudinally spaced, substantially evenly, along the length of the platform 12. Each lower side edge of the platform 12 is undercut along its length, whereby the platform 12 defines a substantially T-shaped cross-section when viewed from the front or rear of the mount 50. In use, one or more firearm accessories 80 can be slidably coupled onto the platform 12 from the end of the mount 50, and then locked into place in one or more of the slots 14. The platform 12 comprises a fixed platform segment 16 and a moveable platform segment, the moveable platform segment hereafter being referred to as arm 20. The arm 20 locates adjacent to, and forward in-use of, the fixed platform segment 16 along the longitudinal length of the base 10. Both the fixed platform segment 16 and the arm 20 are able to simultaneously or separately couple to one or more firearm accessories 80.

The arm 20 is arranged to pivot about a hinge 22 relative to the base 10, with a rotation axis X-X of the hinge 22 extending parallel to a longitudinal axis Y-Y of the base 10. In an engaged configuration, or deployed position, of the arm 20, the arm 20 is retained adjacent the base 10. In a disengaged configuration, or stowed position, of the arm 20, the arm 20 is pivoted away from the base 10. The range of motion of the arm 20 about the hinge 22 can be between approximately 0 and 130 degrees. In a preferred form, the arm 20 is able to pivot to a disengaged configuration that is substantially 90 degrees relative to the engaged configuration adjacent the base 10. A disengaged configuration that is substantially perpendicular relative to base 10 may help to optimise the centre of gravity of the arm 20 and one or more firearm accessories 80 relative to other angles. When configured in the engaged configuration, the top surface 21 of the arm 20 and the top surface 17 of the fixed platform segment 16 have a substantially uniform height above the base 10. The height and/or an angle of the arm 20, in the engaged configuration, can be manually adjusted relative to the base 10 by one or more threaded screws 18 that are arranged to extend through apertures 19 in the base 10 so as to project through the base 10 and interact with an underside 23 of the arm 20. The threaded screws 18 help stabilise the arm 20 by reducing the clearance between the underside 23 of the arm 20 and the base 10. The threaded screws 18 may also, in some variations, assist with aligning the arm 20 with the fixed platform segment 16. For example, with reference to FIGS. 4 and 5, where the accessories 80, 80' being used are a plurality of scopes or sights that require precise alignment with one another in use.

The mount 50 further comprises a release assembly 40 that, when actuated, is adapted to release the arm 20 from the engaged configuration such that the arm 20 is free to pivot towards the disengaged configuration. A slidable member 34 is arranged to slide longitudinally along the base 10 between the base 10 and the underside 23 of the arm 20. The movement of the slidable member 34 is controlled by the release assembly 40, to which the slidable member 34 is coupled. A latch 30 is fixed to, or integral with, the slidable member 34 and arranged to extend away from an upper surface of the slidable member 34 towards a cavity 33, or indent, provided along the underside 23 of the arm 20. A hook 32 is arranged within the cavity 33. The hook 32 is configured to engage with the latch 30 when the arm 20 locates adjacent the base 10, so as to define a locked configuration of the release assembly 40. The hook 32 is further configured to disengage from the latch 30 when the slidable member 34 is moved longitudinally relative to the base 10 of the mount 50, so as to define an unlocked configuration of the release assembly 40.

In variations, such as that shown in the Figures, where the mount 50 comprises a plurality of corresponding pairs of latches 30 and hooks 32, each of the plurality of hooks 32 are evenly spaced from one another along a line that extends substantially parallel to longitudinal axis Y-Y, and each of the plurality of latches 30 are spaced at a corresponding spacing along the slidable member 34. Thus, each of the pairs of latches 30 and hooks 32 would substantially simultaneously be configurable between the locked and unlocked configuration by movement of the slidable member 34. As would be appreciated by one skilled in the art, in a variation the hooks can be formed on the slidable member and the latches can be formed on the underside of the arm. In addition, the number, spacing and pattern of the plurality of pairs of latches and hooks can be varied provided that in use, the movement of the slidable member 34 relative to the base 10 and the arm 20, causes movement of the latch 30 relative to the hook 32 within the cavity 33 such that the latch 30 is disengaged from the hook 32.

The release assembly 40 comprises three pivots, with a first pivot 42 connecting a first distal end of a first member 41 of the release assembly 40 to the base 10, a second pivot 44 connecting a first distal end of a second member 43 of the release assembly 40 to the slidable member 34, and a third pivot 45 connecting between the respective opposing second distal ends of the first and second members 41, 43. The axes through each of the first, second and third pivots 42, 44, 45 are each parallel to one another, and extend perpendicularly to the longitudinal axis Y-Y of the base 10. When viewed from the side, the second member 43 of the release assembly 40 has a substantially L-shaped profile, with the end of the L-shape extending downward from the slidable member 34 towards the third pivot 45. The first member 41 extends substantially linearly from the first pivot 42 at the base 10 towards the third pivot 45. Thus, in variations where the axes through the first and second pivots 41, 44 locates close together, when viewed from the side the first member 41 appears to define the hypotenuse of a triangle formed together with the second member 43 of the release assembly 40, with the third pivot 45 extending away from the base 10 in a direction towards a surface of the firearm 60 to which the mount 50 is mounted.

Figure 6A:
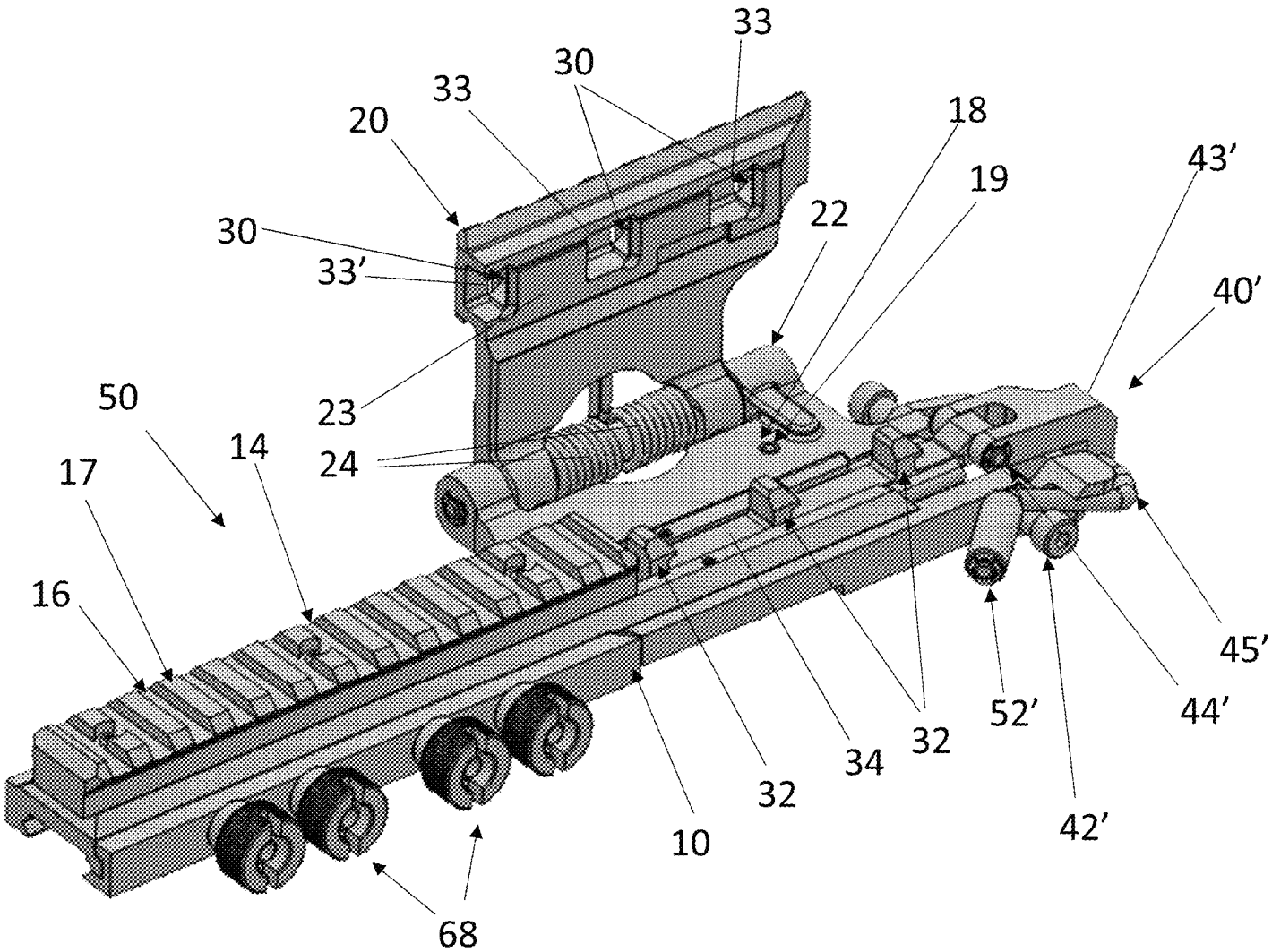
FIGS. 6*a* and 6*b* are rear and front perspective views, respectively, of a further embodiment of a mount for attaching one or more firearm accessories to a firearm, with the arm in a dis-engaged configuration.
Figure 6B:
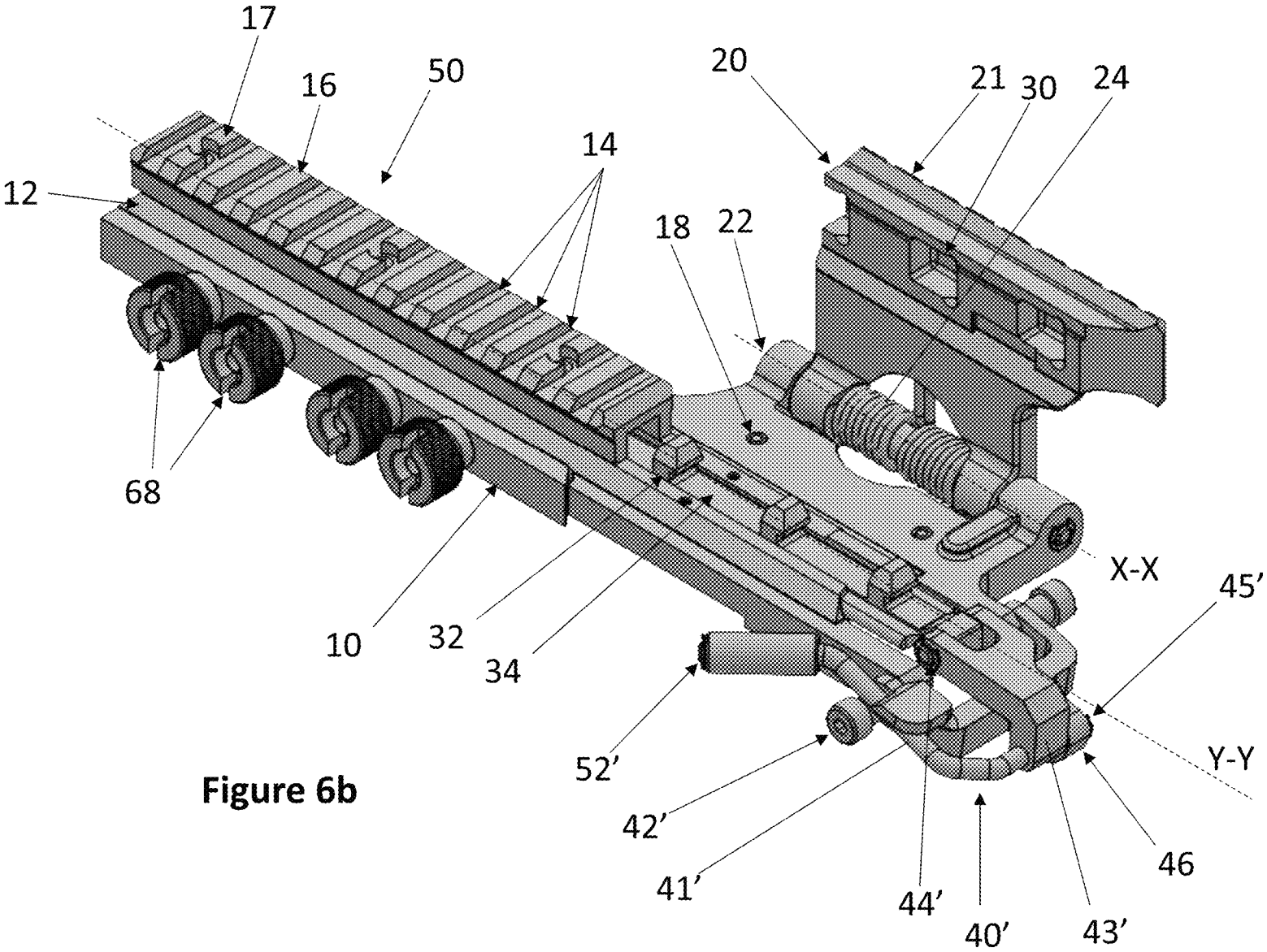
Figure 7:
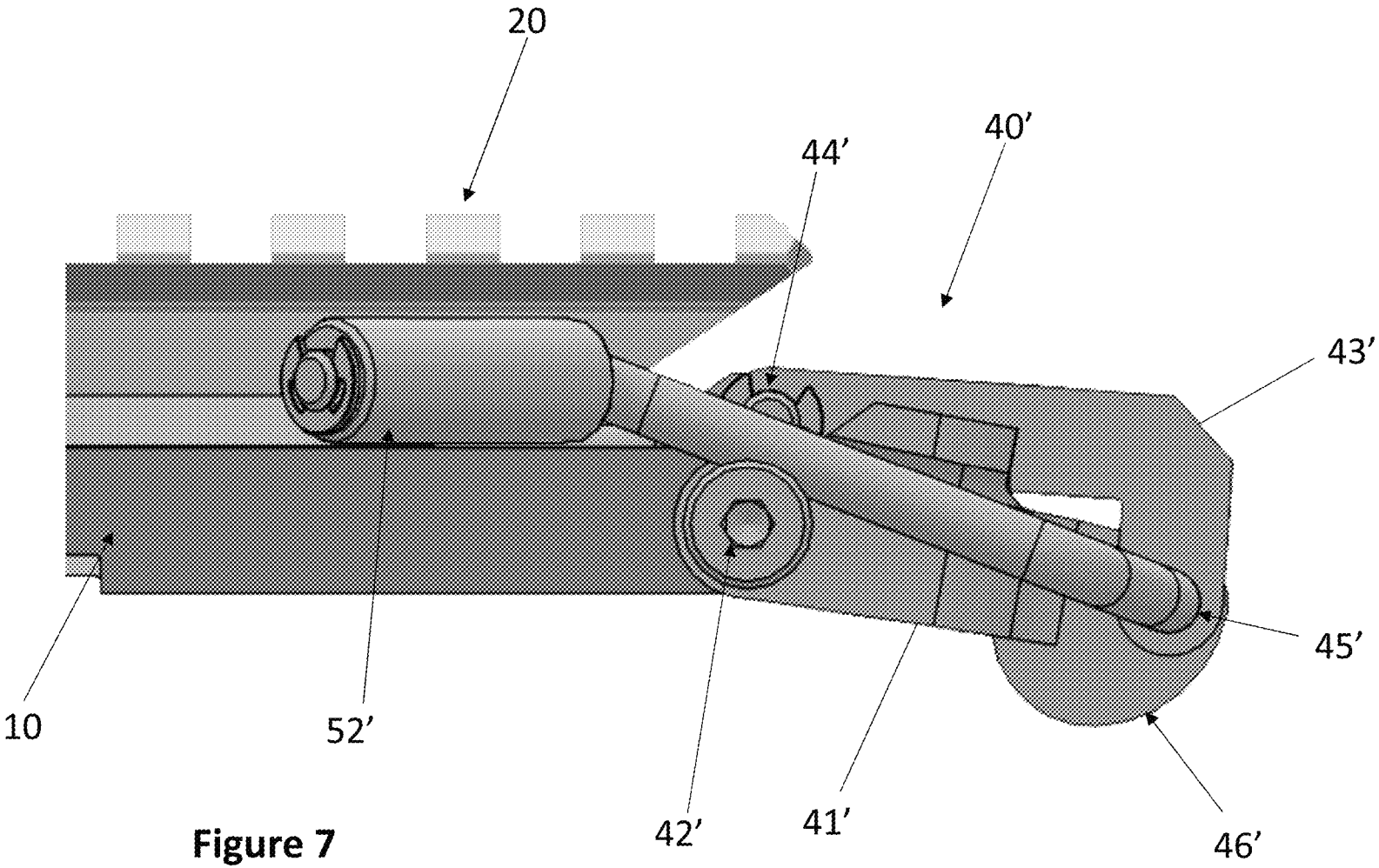
FIG. 7 is a close-up side view of a forward portion of the mount of FIG. 6, with the arm in an engaged configuration.

The third pivot 45 comprises a leading edge 46 at an opposing distal end to the base 10, the leading edge 46 being substantially spherical and having an outer diameter that is centred at an axis through the third pivot 45. The leading edge 46 may assist the pivoting of the release assembly 40 when engaged by the upper portion 62 of the firearm 60. The leading edge 46 can be interchanged with a further leading edge, not shown, of a larger and/or a smaller diameter in order to adjust the length of the release assembly 40 in the direction towards the upper surface 62 of the firearm 60, as required. In addition, the release assembly 40 can have a handle 52 that improves the ease with which a user can manually actuate the release assembly 40. In some variations, referring to FIGS. 6 and 7, the handle 52' of the release assembly 40' can comprise a return bend whereby the handle 52' locates substantially level with the upper portion of the base 10 of the mount 50.

In use, when the release assembly 40 is actuated by being pivoted upwards and away from the surface of the firearm 60 to which the mount 50 is mounted about the first pivot 42, the first pivot 42 connecting the release assembly 40 to the base 10, the substantially L-shaped profile of the second member 43 is lifted and slides laterally towards the base 10. The movement of the second member 43 drives the slidable member 34 to slide along the base 10, disengaging the latches 30 from their respective hooks 32 and into an unlocked configuration. The arm 20 is then free to be pivoted away from the engaged configuration towards the disengaged configuration. The hinge 22 of the arm 20 can also be spring-loaded such that it is biased to pivot the arm 20 away from the base 10. In some variations, the hinge 22 can comprise a plurality of springs 24, which may improve the strength and durability of the spring-loaded biasing mechanism of the hinge 22. In some further variations, not shown, the release assembly can be biased to elastically maintain the slidable member towards the engaged configuration prior to actuation.

Figure 3A:
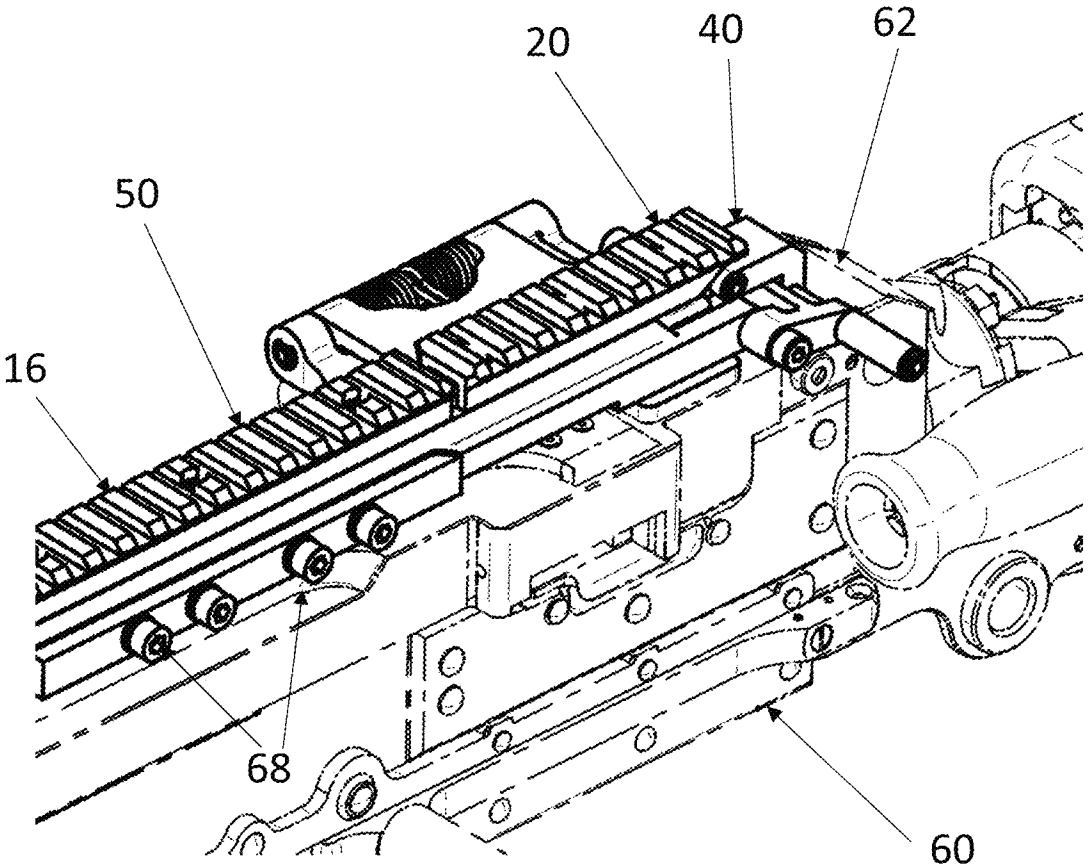
FIGS. 3*a* and 3*b* are rear perspective views of an upper portion of a firearm having the mount of FIG. 1 mounted thereto and with the arm of the mount in an engaged configuration and a disengaged configuration, respectively.
Figure 3B:
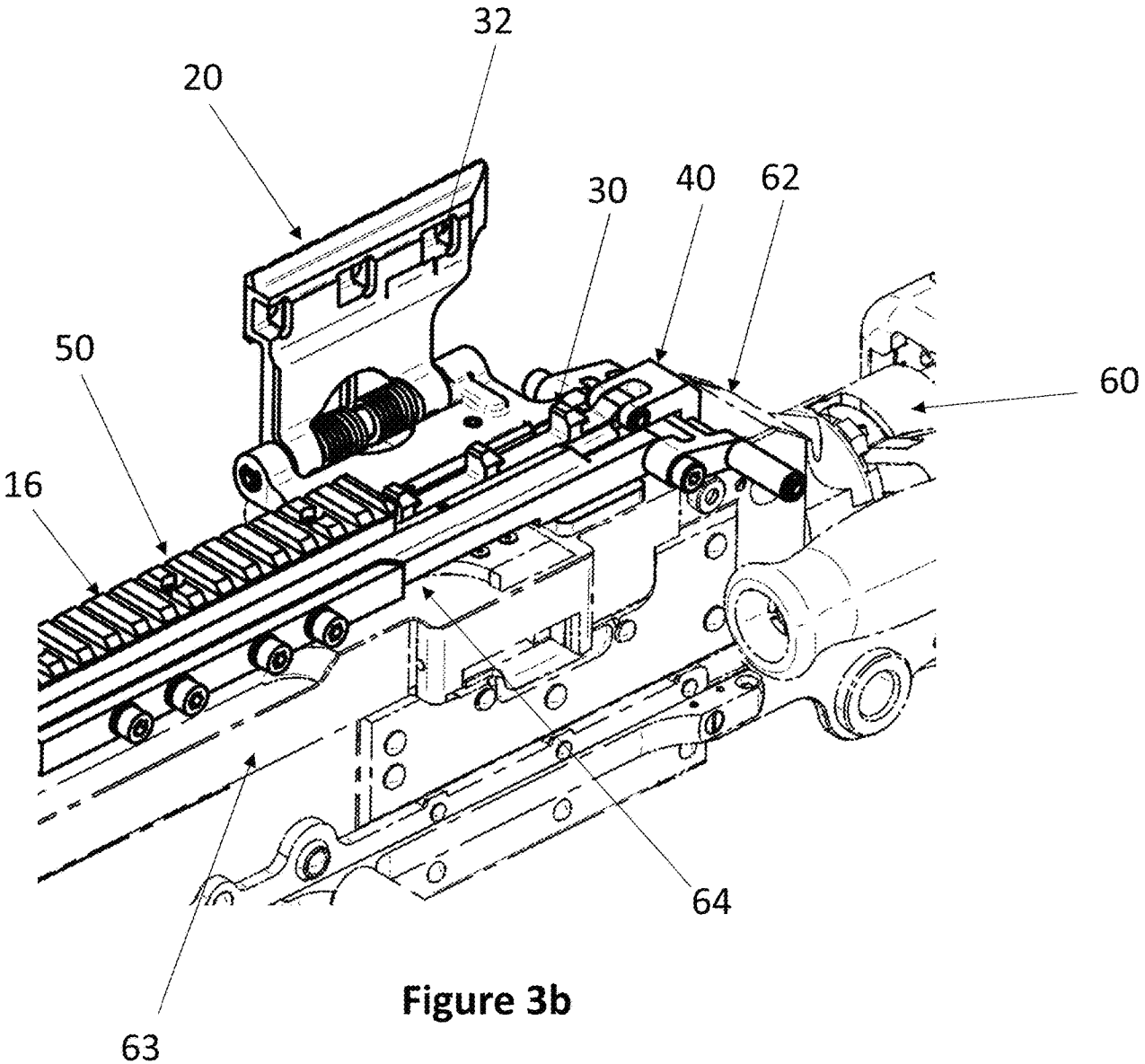
Figure 4A:
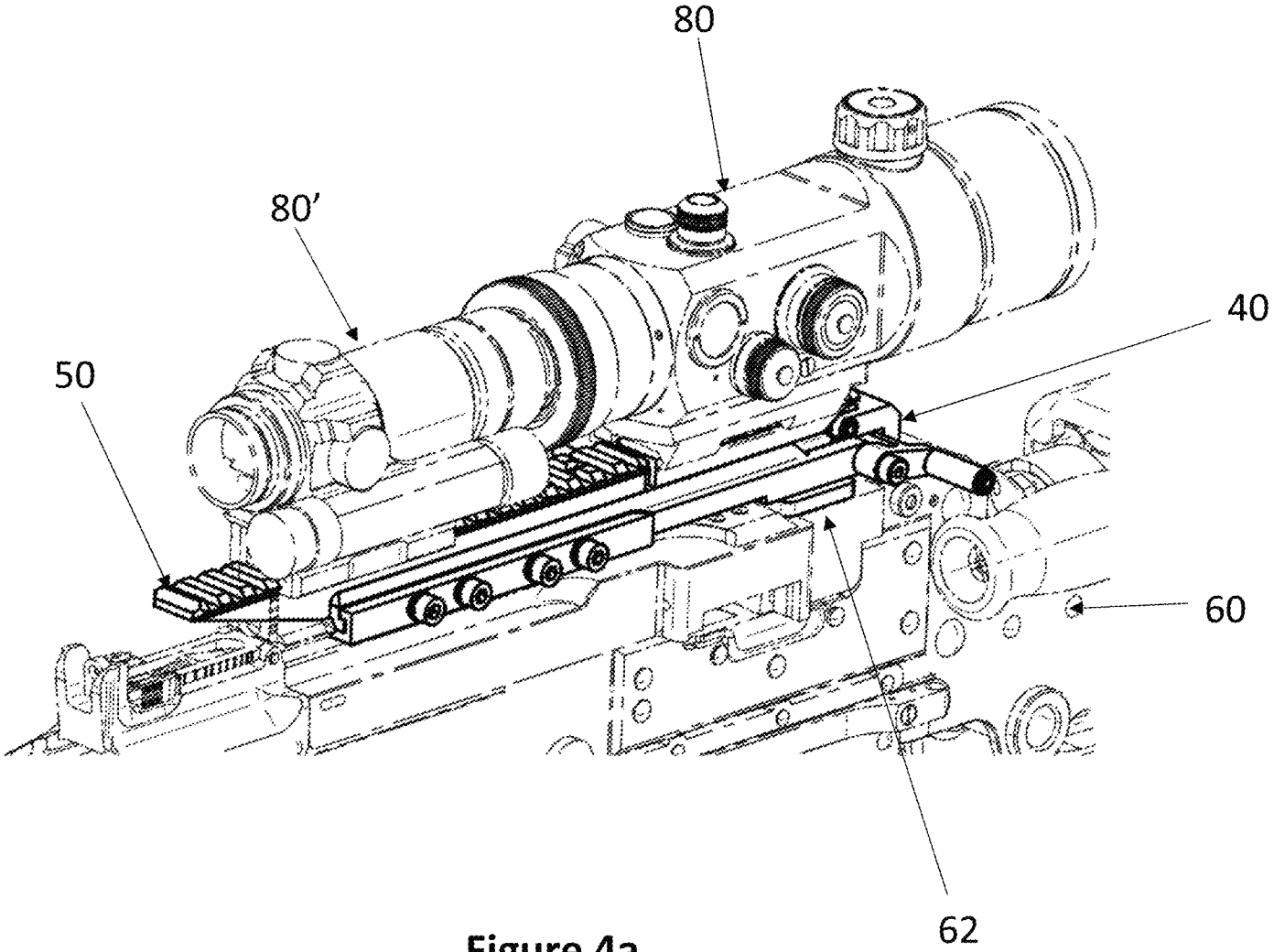
FIGS. 4*a* and 4*b* are rear perspective views of an upper portion of a firearm having the mount of FIG. 1 mounted thereto, and with a plurality of firearm accessories coupled to the mount, with the arm of the mount in an engaged configuration and a disengaged configuration, respectively.
Figure 4B:
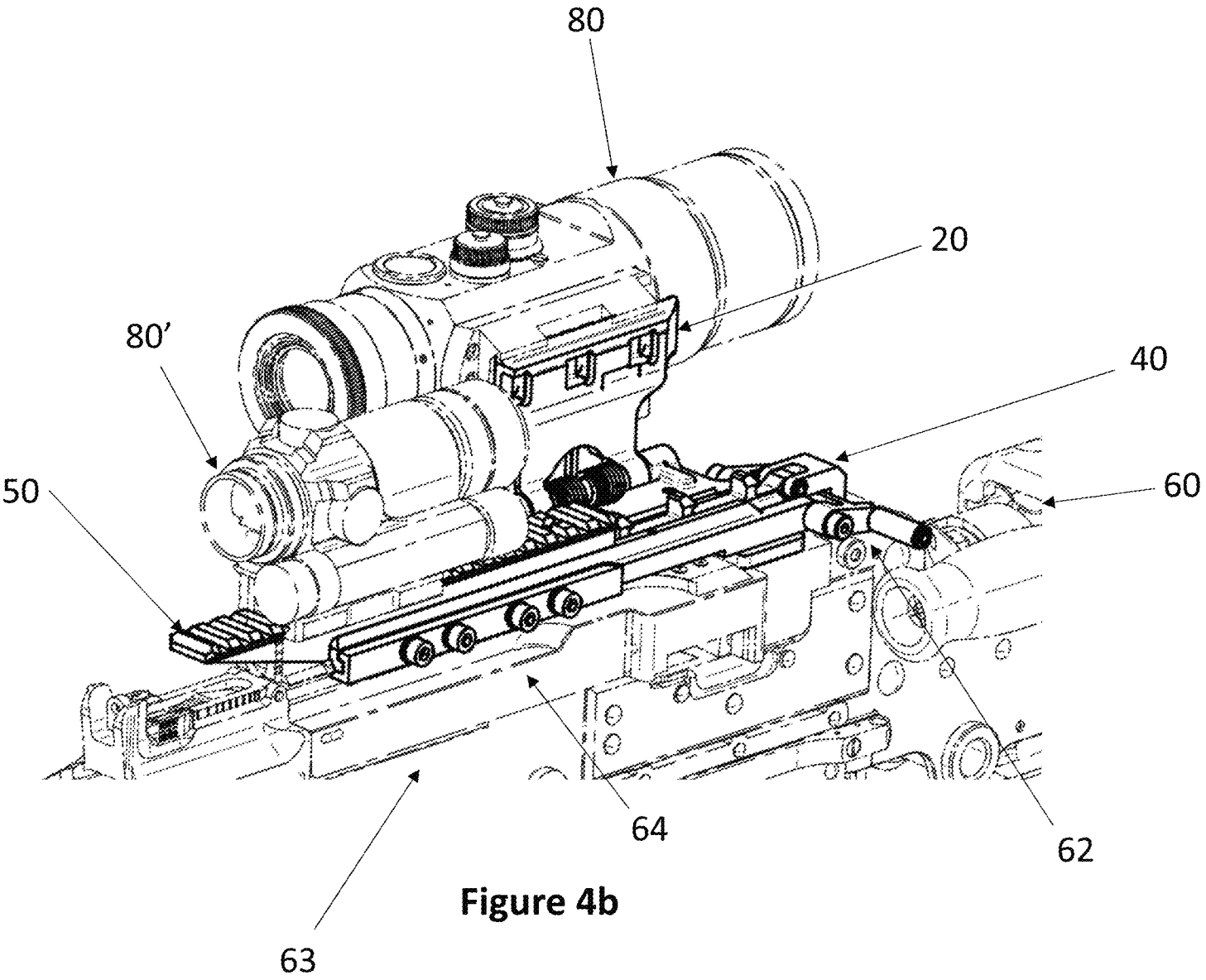
Figure 5:
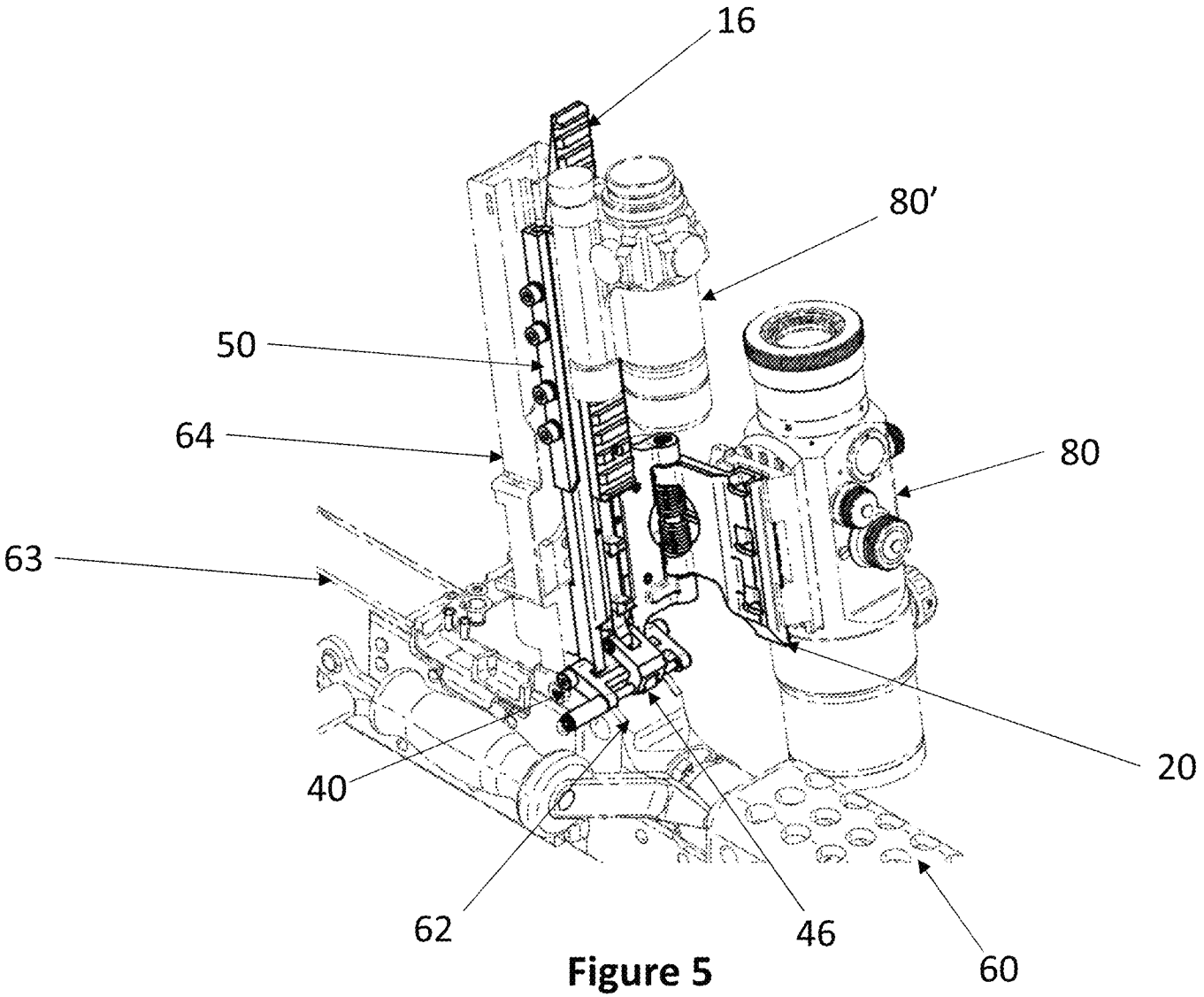
FIG. 5 is a front perspective view of a forward portion of the firearm having the mount of FIG. 1 mounted thereto with a plurality of firearm accessories coupled to the mount, and where the door of the firearm is open and the arm of the mount in a disengaged configuration.

Referring now to FIGS. 3 to 5, the mount 50 can be mounted to the upper portion 62 of the firearm 60 using one or more threaded screws 68 that are inserted through the base 10 and into the firearm 60. For example, the mount 50 can be mounted to an access panel above the ammunition chamber 63 of the firearm 60, hereafter referred to as door 64. The door 64 is able to be pivotally opened to access the ammunition chamber 63, the door 64 being coupled to the upper portion 62 of the firearm 60 via a hinge along an in-use forward edge of the ammunition chamber 63.

In use, as the door 64 is opened from a closed configuration the release assembly 40 is moved towards the upper portion 62 of the firearm 60, the interaction of the upper portion 62 with the leading edge 46 of the release assembly 40 causes the release assembly 40 to be pivoted upwards relative the base 10, thereby actuating the release assembly 40 by moving the slidable member 34 longitudinally relative to the base 10 of the mount 50 to unlock the latch 30 from the hook 32 and releasing the arm 20 into the disengaged configuration. The spring-loaded hinge 22 is then able to pivot the arm 20 away from the base 10, for example to 90 degrees relative to the base 10, and to a stowed position where the firearm accessories 80 coupled to the arm 20 have sufficient clearance away from the body of the firearm 60 as the door 64 is pivoted through approximately 90 degrees to a fully open configuration.

By moving the firearm accessories 80 coupled to the arm 20 a sufficient distance away from the body of the firearm 60, the firearm accessories 80 do not impede the opening of the door 64. Nor do the firearm accessories 80 need to be removed from the mount 50 in order to access the ammunition chamber 63 of the firearm 60. This improves the speed with which the firearm 60 can be returned to a state of readiness, with the firearm accessories 80 deployed, accurately aligned, and ready for use. In addition, during times on non-use, or when access to the ammunition chamber 63 is required, the firearm accessories 80 can be quickly and easily moved to a stowed position, where the firearm accessories 80 is not likely to be bumped out of alignment and that provides a relatively streamlined profile for the firearm 60.

Variations and modifications may be made to the parts previously described without departing from the spirit or ambit of the disclosure.

Various further examples of aspects of the subject technology are described as numbered clauses (1, 2, 3, etc.) for convenience. These are provided as examples and do not limit the subject technology.

Clause 1: A mount for attaching one or more firearm accessories to a firearm, the mount comprising a base that is mountable to an upper portion of the firearm; an arm adapted for coupling to a first firearm accessory, the arm being pivotally coupled to the base whereby in an engaged configuration the arm is retained adjacent the base, and in a disengaged configuration the arm is able to pivot away from the base; and a release assembly connected to the base, wherein when actuated the release assembly is adapted to release the arm from the engaged configuration wherein the arm is able to pivot towards the disengaged configuration.

Clause 2: The mount of clause 1, wherein the release assembly is actuated by a pivotal movement of the release assembly relative to the base.

Clause 3: The mount of clause 2, wherein the pivotal movement of the release assembly is via a pivot connecting the release assembly to the base, a rotation axis of the pivot extending perpendicularly to a longitudinal axis of the base.

Clause 4: The mount of any one of the preceding clauses, wherein the release assembly extends from the base in a direction towards a surface of the firearm.

Clause 5: The mount of clause 4, wherein a length of the release assembly in the direction towards a surface of the firearm is adjustable.

Clause 6: The mount of any one of the preceding clauses, wherein a leading edge is coupled to a distal end of the release assembly.

Clause 7: The mount of clause 6, when dependent on clause 5, wherein the leading edge is interchangeable with a further leading edge of a larger and/or a smaller diameter, thereby adjusting the length of the release assembly in the direction towards a surface of the firearm.

Clause 8: The mount of any one of the preceding clauses, wherein the release assembly further comprises a handle.

Clause 9: The mount of any one of the preceding clauses, wherein the release assembly is biased towards the engaged configuration.

Clause 10: The mount of any one of the preceding clauses, wherein the mount comprises a latch and a hook arrangement, wherein when the latch and the hook engage one another they retain the arm in the engaged configuration.

Clause 11: The mount of clause 10, wherein actuation of the release assembly disengages the latch from the hook.

Clause 12: The mount of clauses 10 or 11, wherein the release assembly includes a slidable member comprising the latch or the hook.

Clause 13: The mount of clause 12, wherein actuation of the release assembly causes the slidable member to move longitudinally relative to the base of the mount between a locked configuration, where the latch is engaged with the hook, and an unlocked configuration, where the latch is disengaged from the hook.

Clause 14: The mount of any one of clauses 10 to 13, wherein the mount comprises a plurality of corresponding pairs of the latches and the hooks.

Clause 15: The mount of any one of the preceding clauses, wherein the arm is arranged to pivot about a hinge relative to the base, a rotation axis of the hinge extending parallel to a longitudinal axis of the base.

Clause 16: The mount of clause 15, wherein the hinge is spring-loaded.

Clause 17: The mount of any one of the preceding clauses, wherein in the disengaged configuration the arm is able to pivot substantially 90 degrees relative to the base.

Clause 18: The mount of any one of the preceding clauses, wherein in the engaged configuration a height and/or an angle of the arm is adjustable relative to the base.

Clause 19: The mount of clause 18, wherein one or more threaded screws are arranged to extend through a corresponding one or more apertures of the base so as to project through the base and interact with an underside of the arm.

Clause 20: The mount of any one of the preceding clauses, wherein the mount comprises a platform for coupling to a second firearm accessory, the platform locating adjacent the arm and being fixed relative to the base.

Clause 21: The mount of clause 20, wherein in the engaged configuration a top surface of the arm and a top surface of the platform are at a substantially uniform height above the base.

Clause 22: A firearm assembly comprising the mount of any one of the preceding clauses mounted to the upper portion of the firearm.

Clause 23: The firearm assembly of clause 22, further comprising the first firearm accessory coupled to the arm of the mount.

Clause 24: The firearm assembly of clauses 22 or 23, when dependent on clause 20, further comprising the second firearm accessory coupled to the platform of the mount.

Clause 25: The firearm assembly of any one of clauses 22 to 24, wherein the first firearm accessory comprises one or more of a lights, sight, grip, bipod or tripod, sling, and bayonet.

Clause 26: The firearm assembly of any one of clauses 22 to 25, when dependent on clause 20, wherein the second firearm accessory comprises one or more of a lights, sight, grip, bipod or tripod, sling, and bayonet.

Clause 27: The firearm assembly of any one of clauses 22 to 26, wherein the upper portion of the firearm is a door which is able to be pivotally opened.

Clause 28: The firearm assembly of clause 27, wherein the door is able to pivot through 90 degrees relative to a closed configuration.

Clause 29: The firearm assembly of clauses 27 or 28, wherein when the door is pivoted to an open configuration the release assembly is actuated to release the arm from the engaged configuration.

Clause 30: The firearm assembly of clause 29, when dependent on clauses 6 and 13, wherein in the open configuration the leading edge interacts with the surface of the firearm such that the release assembly is moved pivotally about the pivot that connects the release assembly to the base whereby the slidable member is moved longitudinally relative to the base of the mount to disengage the latch from the hook.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The invention claimed is:

1. A mount for attaching one or more firearm accessories to a firearm, the mount comprising a base that is mountable to an upper portion of the firearm;

an arm adapted for coupling to a first firearm accessory, the arm being pivotally coupled to the base whereby in an engaged configuration the arm is retained adjacent the base, and in a disengaged configuration the arm is able to pivot away from the base; and a release assembly connected to the base, wherein when actuated the release assembly is adapted to release the arm from the engaged configuration wherein the arm is able to pivot towards the disengaged configuration;

wherein, when the mount is attached to the firearm, the release assembly includes a length that is adjustable extending from the base in a direction toward a surface of the firearm.

2. The mount as claimed in claim 1, wherein the release assembly is actuated by a pivotal movement of the release assembly relative to the base.

3. The mount as claimed in claim 2, wherein the pivotal movement of the release assembly is via a pivot connecting the release assembly to the base, a rotation axis of the pivot extending perpendicularly to a longitudinal axis of the base.

4. The mount as claimed in claim 1, wherein a leading edge is coupled to a distal end of the release assembly.

5. The mount as claimed in claim 4, wherein the leading edge is interchangeable with a further leading edge.

6. The mount as claimed in claim 1, wherein the release assembly further comprises a handle.

7. The mount as claimed in claim 1, wherein the mount comprises a latch and a hook arrangement, wherein when the latch and the hook engage one another they retain the arm in the engaged configuration.

8. The mount as claimed in claim 7, wherein actuation of the release assembly disengages the latch from the hook.

9. The mount as claimed in claim 7, wherein the release assembly includes a slidable member comprising the latch or the hook.

10. The mount as claimed in claim 9, wherein actuation of the release assembly causes the slidable member to move longitudinally relative to the base of the mount between a locked configuration, where the latch is engaged with the hook, and an unlocked configuration, where the latch is disengaged from the hook.

11. The mount as claimed in claim 1, wherein the arm is arranged to pivot about a hinge relative to the base, a rotation axis of the hinge extending parallel to a longitudinal axis of the base.

12. The mount as claimed in claim 1, wherein in the disengaged configuration the arm is able to pivot substantially 90 degrees relative to the base and/or wherein in the engaged configuration a height and/or an angle of the arm is adjustable relative to the base.

13. The mount as claimed in claim 1, wherein the mount comprises a platform for coupling to a second firearm accessory, the platform locating adjacent the arm and being fixed relative to the base.

14. A firearm assembly comprising:

a fire arm having an upper portion; and a mount for attaching one or more firearm accessories to the firearm, the mount comprising a base mounted to the upper portion of the firearm;

an arm adapted for coupling to a first firearm accessory, the arm being pivotally coupled to the base whereby in an engaged configuration the arm is retained adjacent the base, and in a disengaged configuration the arm is able to pivot away from the base; and a release assembly connected to the base, wherein when actuated the release assembly is adapted to release the arm from the engaged configuration wherein the arm is able to pivot towards the disengaged configuration;

wherein the release assembly comprises a length that is adjustable extending from the base in a direction toward a surface of the firearm.

15. The firearm assembly as claimed in claim 14, further comprising a first firearm accessory coupled to the arm of the mount and/or further comprising a second firearm accessory coupled to a platform of the mount.

16. The firearm assembly as claimed in claim 15, wherein the first firearm accessory and/or the second firearm accessory comprises one or more of a lights, sight, grip, bipod or tripod, sling, and bayonet.

* * * * *